United States Patent [19]

Grabovez

[11] 4,168,564

[45] Sep. 25, 1979

[54] THERMALLY PROTECTED VACUUM HOSE ASSEMBLY

[75] Inventor: Victor M. Grabovez, Troy, Ohio

[73] Assignee: Dayco Corporation, Dayton, Ohio

[21] Appl. No.: 958,901

[22] Filed: Nov. 3, 1978

[51] Int. Cl.[2] ..... A47L 9/28

[52] U.S. Cl. ..... 15/377; 29/622; 318/472

[58] Field of Search ..... 15/377; 361/103; 174/47; 318/472; 29/456, 622, 628; 156/143

[56] References Cited

U.S. PATENT DOCUMENTS

| | | | |
|---|---|---|---|
| 3,636,285 | 1/1972 | Wickham et al. | 15/377 X |
| 3,697,812 | 10/1972 | Hehl | 361/103 |
| 3,956,725 | 5/1976 | Merrill et al. | 337/407 |

*Primary Examiner*—Christopher K. Moore
*Attorney, Agent, or Firm*—Reuben Wolk

[57] ABSTRACT

A vacuum hose assembly, method of making same, and vacuum cleaner employing same are provided wherein the hose assembly comprises a thermally actuated switch which breaks the electrical circuit through cooperating electrical leads of an electrical system thereof once a predetermined temperature level is reached by the switch to prevent the possibility of fire and electrical shock in the event of fire-exposed leads.

20 Claims, 4 Drawing Figures

THERMALLY PROTECTED VACUUM HOSE ASSEMBLY

BACKGROUND OF THE INVENTION

1. Field of the Invention

This invention relates to an electrical power carrying vacuum hose assembly, method of making same, and a vacuum cleaner employing such hose assembly.

2. Prior Art Statement

Canister type vacuum cleaners are widely used in industry and each of such vacuum cleaners normally employs a vacuum tank having an electric powered vacuum unit, an electric motor driven cleaning instrument for operation remotely from the vacuum tank, and a vacuum hose assembly operatively connecting the cleaning instrument to the tank wherein the vacuum hose assembly usually has a pair of wires extending therealong which serve the dual purpose of electrical conductors and hose reinforcing wires. These dual-purpose wires due to their reinforcing character have a comparatively high electrical resistance which tends to cause substantial heating thereof and of electrical leads of the vacuum cleaner electrical system which are operatively connected to such wires. However, it is possible to encounter abnormal electrical operating conditions due to so-called electrical short circuits, malfunction or stalling of an electric motor associated with the cleaning instrument, poor manufacturing controls, on electrical leads and other electrical system components, and the like.

It is also common practice for many canister type vacuum cleaners of this type to be provided with protective fuses which are actuated by comparatively high electrical current. However, these current actuated fuses have their own characteristic deficiencies including some which are slow acting or act after a designed time delay whereby it is possible to have a safety problem even in a canister type vacuum cleaner which is protected by a high electric current actuated fuse. Indeed, it is possible under abnormal electrical operating conditions of the character mentioned for the electrical conductors of the vacuum cleaner electrical system and particularly the dual-purpose wires comprising the hose assembly to become sufficiently hot to burn their electrical insulation and possibly start a larger fire as well as present the potential hazard of electrical shock due to fire-exposed leads.

SUMMARY

It is a feature of this invention to provide a canister type vacuum cleaner which is protected by a thermally actuated device which breaks the electrical circuit through cooperating electrical leads of its electrical system once a predetermined temperature level is reached by the device.

Another feature of this invention is to provide a thermally actuated device of the character mentioned in the form of a switch which operates at any desired location in the electrical circuit for the vacuum cleaner.

Another feature of this invention is to provide a vacuum hose assembly for a canister type vacuum cleaner which comprises a pair of wires extending along the assembly which serve the dual purpose of electrical conductors and hose reinforcing wires and which employ a thermally actuated switch connected in series with at least one of the wires wherein such switch breaks an electrical circuit through the wires with the hose assembly operatively connected on a vacuum cleaner and once a predetermined temperature level is reached by the switch.

Another feature of this invention is to provide a method of making an electric power carrying vacuum hose assembly for a canister type vacuum cleaner which employs a protective temperature responsive electrical switch of the character mentioned.

Another feature of this invention is to provide a method of the character mentioned which includes the step of providing means for quickly connecting and disconnecting the protective temperature responsive switch in the vacuum hose assembly.

Therefore, it is an object of this invention to provide an improved vacuum hose assembly, method of making same, and vacuum cleaner employing same having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DESCRIPTION OF ILLUSTRATED EMBODIMENTS

Figure 1:
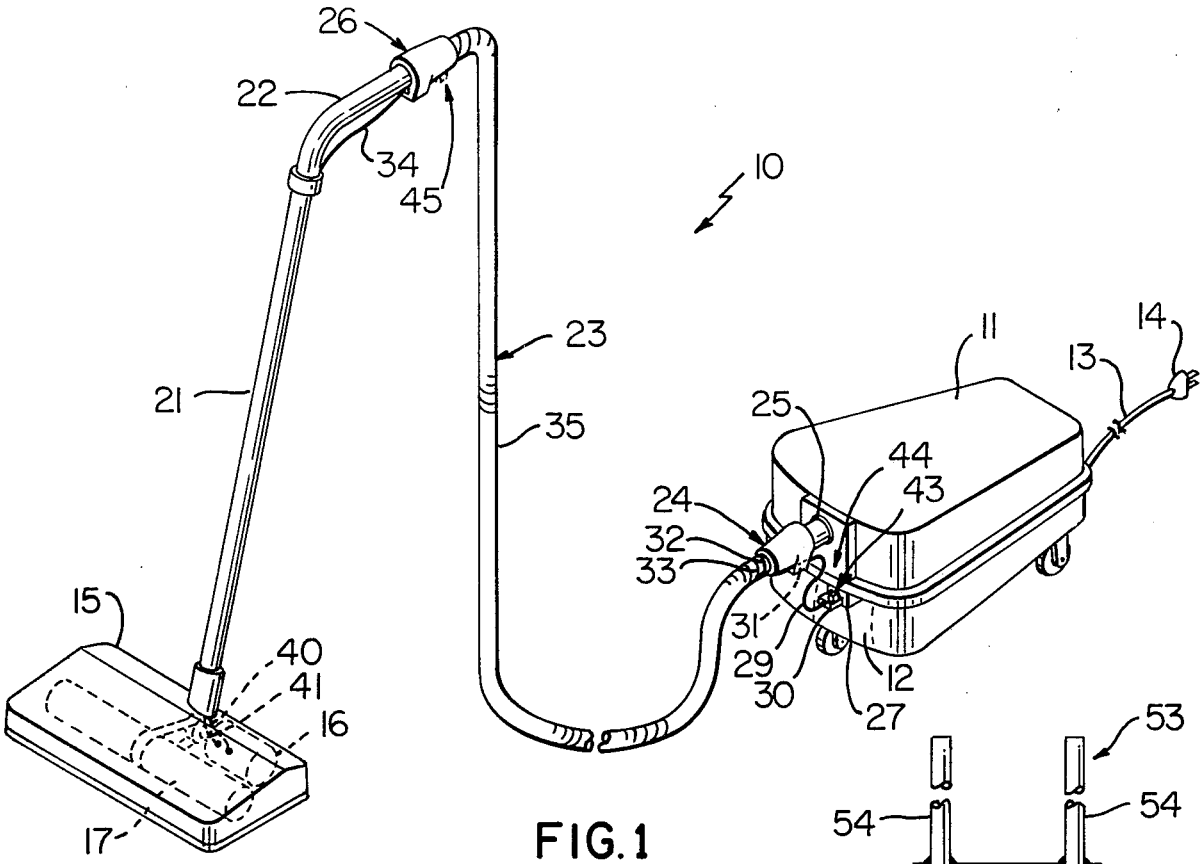
FIG. 1 is a perspective view with parts broken away particularly illustrating an exemplary embodiment of a canister type vacuum cleaner of this invention and which employs a vacuum hose assembly and method of making same in accordance with this invention.

Reference is now made to FIG. 1 of the drawing which illustrates an exemplary canister type vacuum cleaner of this invention which is designated generally by the reference numeral 10. The vacuum cleaner 10 comprises a vacuum tank 11 having an electric powered vacuum unit 12 and an electrical cord assembly 13 connected to the tank 11 and vacuum unit 12 for supplying electrical power thereto from a power source. For example, cord assembly 13 has a common electrical plug 14 which is particularly adapted to be electrically connected in the usual household outlet which in the United States provides 120 volt 60 cycle alternating current power.

The vacuum cleaner 10 comprises a cleaning instrument which is designated generally by the reference numeral 15 and in this example a floor unit of the type known in the art is shown and used for operation and cleaning remotely from the tank 11. The floor unit or cleaning instrument 15 has an electric motor 16 which drives a rotatable cleaning brush 17, or the like, of the cleaning instrument through a suitable mechanical connection and as is known in the art. The cleaning instrument 15 has an upstanding tubular portion 21 terminating in a handle portion 22 and the handle portion is used to push the floor unit around a floor or carpet to provide cleaning thereof.

Vacuum cleaner 10 also comprises a vacuum hose assembly 23 in accordance with the teachings of this invention which operatively connects the cleaning instrument 15 to the tank 11; and, as will be apparent from FIG. 1 of the drawing the vacuum hose assembly 23 has a male hose connector 24 which connects one end of the hose assembly 23 within an associated female fitting 25 in the tank 11. The hose assembly 23 has a female hose connector 26 at its opposite end which is operatively connected to the tubular handle portion 22 of the upright tubular extension 21 of the cleaning instrument 15.

The vacuum cleaner 10 has an electrical system for supplying electrical power from the tank to the cleaning instrument and it will be appreciated that electrical power is provided to appropriate locations in the tank, including the vacuum unit 12, through the cord assembly 13. Electrical connectors of any suitable type known in the art are provided within the vacuum tank 11 and include a female electrical connector 27 which is supplied with electrical power from the cord assembly 13. The electrical system for supplying electrical power from the tank 11 to the cleaning instrument 15 comprises an electrical cable assembly 29 having a male electrical connector or plug 30 connected to the female connector 27 of the tank 11 and a female electrical connector 31. The cable assembly 29 is connected by its female connector 31 to a pair of wires 32 and 33 extending along the hose assembly 23 and the wires 32 and 33 will be described in detail subsequently. The electrical system also comprises another electrical cable assembly 34 suitably electrically connected to the wires 32 and 33 at the end of the vacuum hose assembly 23 opposite from the vacuum tank 11 and the electrical cable assembly 34 extends along the handle 22, upright tubular extension 21, and into the housing of the cleaning instrument 15 to the electric motor 16 for rotation of such motor for cleaning purposes.

The pair of wires 32 and 33 extending along the vacuum hose assembly 23 are of a type well known in the art and an example of a vacuum cleaner hose assembly employing such wires is shown in U.S. Pat. No. 3,928,715 and the disclosure of this patent is incorporated herein by reference thereto. As known in the art the wires 32 and 33 serve the dual purpose of electrical conductors and hose reinforcing wires and such wires are preferably helically wound along the vacuum hose assembly 23 thereby providing reinforcement of a polymeric hose portion 35 particularly against collapse under vacuum conditions while still providing the vacuum hose assembly 23 with optimum flexiblity.

In order to achieve a high level of reinforcement of the vacuum hose assembly 23, the wires 32 and 33 have a comparatively high electrical resistance and this high electrical resistance is in large measure due to the fact that such wires are made of materials having comparatively high structural strength though comparatively poorer electrical conductivity. For example, the wires 32 and 33 may be made of carbon steel and to increase the electrical conductivity thereof the wires are usually clad or provided with a layer of a better electrical conductor therearound, such as a layer of copper.

Under abnormal operating conditions, such as a so-called electrical short circuit condition, a situation where the motor 16 is jammed against rotation, and the like, such wires 32 and 33 tend to heat to comparatively high temperatures and the heating of such wires causes heating not only of the wires 32 and 33 but also of other interconnected cooperating electrical leads of the electrical system of the vacuum cleaner 10. Thus, an abnormal electrical condition will cause heating of wires 32 and 33 as well as the electrical lead 36 of the cable assembly 29 connected to the wire 32 and the wire 37 of the cable assembly 29 connected to the wire 33. Similarly such electrical heating will cause heating of leads 40 and 41 of the electrical cable assembly 32 wherein the lead 40 is connected to wire 32 and lead 41 is connected to wire 33.

Figure 2:
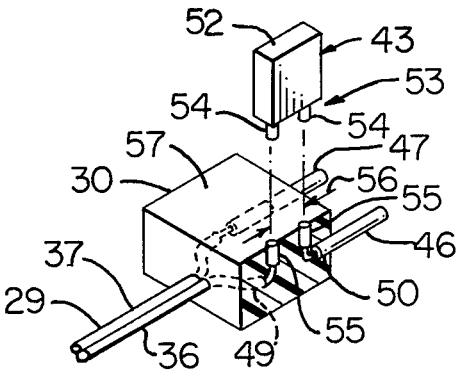
FIG. 2 is a perspective view with parts broken away illustrating a thermally actuated switch installed on a plug portion of an electrical cable assembly comprising the electrical system of the vacuum cleaner of FIG. 1.

The vacuum cleaner 10 comprises a thermally actuated device in the form of a switch, such as switch 43 of FIG. 2, which breaks the electrical circuit through the vacuum cleaner's cooperating electrical leads (i.e., leads comprised of wires 32–33, leads 36–37, and leads 40–41) which define the cleaner's electrical system. The operation of the electrical switch 43 will be described in detail subsequently; however, basically such switch breaks the electrical circuit through the cooperating leads once a predetermined temperature level is reached by the switch as determined by the designed temperature setting of such switch. The designed temperature level may vary for different vacuum cleaners and a thermally actuated switch is commercially available which is temperature activated at a predetermined temperature within a tolerance range of plus 0° Centigrade and minus 4° Centigrade.

In most applications a single temperature actuated switch 43 is used in an electrical circuit for a vacuum cleaner; however, to highlight that the location of the switch in a particular electrical system or circuit may vary a switch 43 is shown at two locations 44 and 45 in the electrical circuit of the vacuum cleaner 10. In particular, the thermally actuated switch 43 at location 44 is installed in the male plug 30 of the electrical cable assembly 29 and the switch 43 at location 45 is installed in the hose connector 26 of the vacuum hose assembly 23. The preferred location of a switch 43 is somewhere on the vacuum hose assembly 23 and in particular on a hose connector of such assembly. In the event that a plurality of thermally actuated switches 43 are used in an electrical system of a vacuum cleaner each of such switches may have a different actuating temperature or temperature setting.

The thermally actuated switch 43 at location 44 is electrically connected in the system in the plug 30. The plug 30 has a pair of electrical elements or pins 46 and 47 and each pin is connected with an associated lead of the electrical cable assembly 29. For example, pin 46 is connected with electrical lead 36 while pin 47 is connected with electrical lead 37. It will be seen that the switch 43 is connected in series between element 46 and its lead 36.

The plug 30 is made of an electric insulating material such as a synthetic plastic material which serves as a matrix for and surrounds embedded portions of its element 46 and 47. Means is provided for connecting and removing the switch 43 between the pin 46 and its associated lead 36 while keeping the embedded portion 50 of element 46 and an associated embedded end 49 of lead 36 in a protected position.

The switch 43 preferably has a main body portion 52 and a plug in the form of a male plug designated generally by the numeral 53 and comprised of a pair of pins each designated by the same reference numeral 54. The plug 53 extends outwardly from the main body 52 of the switch 43 and thus is of a quick connect-disconnect type. It will be seen that a pair of pin receiving sleeves 55 is provided and each sleeve 55 is suitably fixed to an associated terminal end of pin 46 or lead 36. The tubular sleeves 55 are disposed in spaced parallel relation with the center distance 56 therebetween precisely controlled so as to receive the pins 54 in a quick connect-disconnect manner. It will also be appreciated that the outer surfaces of the sleeves 55 are recessed beneath an outside surface 57 of the plug 30 whereby such sleeves 55 and the embedded end portions 49 and 50 of leads 36 and pin 46 respectively are in a protected and electrically isolated position.

Figure 3:
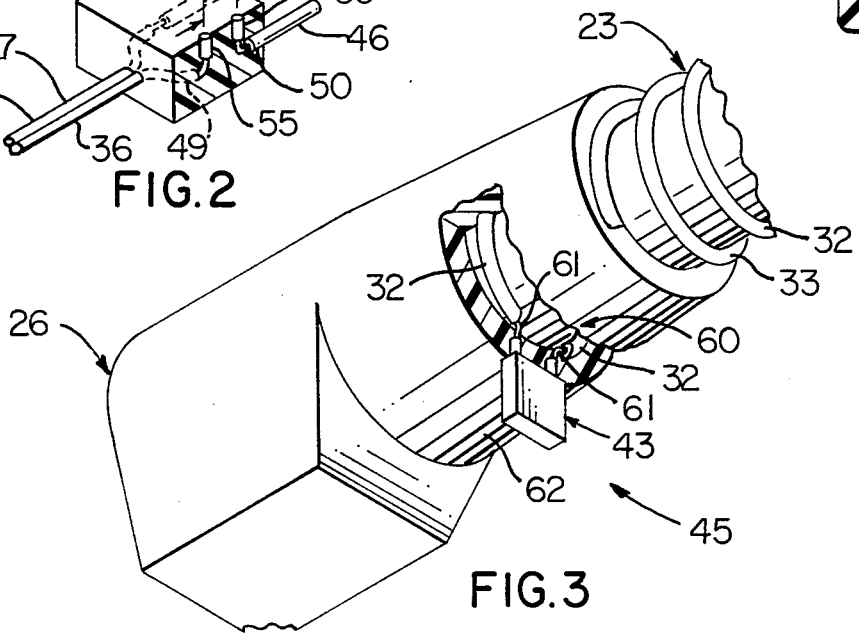
FIG. 3 is a perspective view with parts broken away illustrating another thermally actuated switch installed in position on a hose connector of the vacuum hose assembly of FIG. 1.

As indicated earlier, the switch 43 is preferably installed in the vacuum hose assembly 23 on a hose connector. As shown in FIGS. 1 and 3 of this example of the invention the switch 43 is installed on the hose connector 26 at location 45. To facilitate installation of the thermally actuated switch 43 on the hose connector 26, the wire 32 has a portion thereof cut away as shown at 60 in FIG. 3 and portions of wire 32 are bent in a substantially L-shape to define spaced L-shaped end portions 61. A sleeve 55 indentical to the previously described sleeve 55 is mechanically and electrically connected to each L-shaped end portion 61; and, the sleeves are embedded in the polymeric material defining the hose connector 26 and extend therethrough so terminal end portions thereof are disposed in a protected position beneath the substantially tubular outside surface 62 of the hose connector 26. With this arrangement it is a simple matter to quickly detach and attach the switch 43 on hose connector 26 and in a similar manner as previously described in connection with the plug 30.

Figure 4:
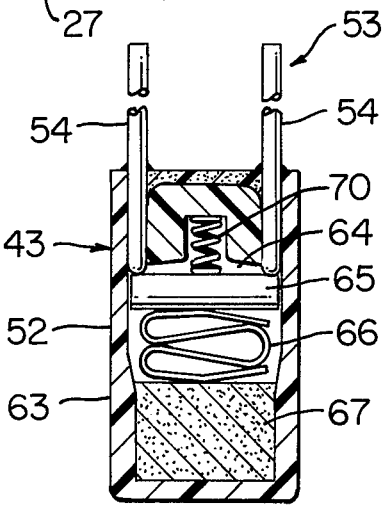
FIG. 4 is an as view with parts in cross section and parts in elevation of a step thermally actuated switch of the type illustrated in FIGS. 2 and 3.

The switch 43 is, in essence, self-actuated and may be of any suitable type known in the art and one example of a switch which may be used is shown in FIG. 4 of the drawing and is disclosed in detail in the U.S. Pat. No. 3,956,725, the disclosure of which is incorporated herein by reference thereto. As disclosed in this patent the switch 43 has its main body portion 52 defined by a suitable housing 63 which is made of an electrically insulating polymeric material and such housing defines a chamber 64 therewithin. The previously described pins 54 of switch 43 have inner ends which are exposed in the chamber 64 and such pins are held fixed by embedment in a wall portion of housing 63. The inner ends of pins 54 have an electrically conductive contact bar 65 extending therebetween and such bar is held against the inner ends of the pins 54 by a compression spring 66. The spring 66 has one end which engages the bar 65 and an opposite end which engages a temperature sensitive member 67 which is adapted to collapse once it reaches a predetermined temperature. Upon collapse of the member 67, the spring 65 is constructed such that it is ineffective in urging contact bar 65 against the ends of the pins 54 whereby a so-called trip spring 70 provided in the housing 63 acts between a portion of the housing 63 and the contact bar 65 moving same away from the pins 54 and interrupting the connection between the pins 54.

During operation of the switch 43 at temperatures below the temperature setting of the member 67 an electrical circuit is completed between the inner ends of the pins 54 via the contact member 65. However, upon collapse of the member 67 by a predetermined temperature thereof defined by its construction, the trip spring 70 urges the contact bar 65 away, as described above, and breaks the electrical circuit across the pins 54 and hence breaks the electrical circuit in the electrical system of the vacuum cleaner 10.

The wires 32 and 33 comprising the vacuum hose assembly 23 are preferably electrically insulated wires and such wires may be insulated utilizing any suitable insulating material or sleeve known in the art and employed for this purpose. It will also be appreciated that the materials employed in making the hose assembly 23 including its tubular central portion 32 and hose connectors 24 and 26 may be any suitable polymeric material employed in the art.

The thermally actuated switch described in connection with U.S. Pat. No. 3,956,725 is commercially available from Micro Devices Division of Emerson Electric Co., P. O. Box 501, Dayton, Ohio 45419, and is sold under the registered trademark "PICOTEMP." This switch is of the nonresettable type and must be replaced once it has actuated by reaching its predetermined temperature level or setting.

However, it will be appreciated that any other suitable thermally actuated device or switch may be provided and employed in accordance with the teachings of this invention and such a switch may be a modified self-actuated switch 43 of a resettable type operating in the manner of a conventional circuit breaker.

It will also be appreciated that suitable means may be provided on the switch 43 whether of the resettable type or of the type which must be replaced once used to indicate that such switch has been actuated by exposure thereof to its preset temperature. One technique that may be employed in connection with a nonresettable switch is providing a material on switch 43 which changes color once its predetermined setting temperature has been reached indicating the switch has self activated. Once such color is observed the user of the vacuum cleaner 10 is advised that it is necessary to replace the nonresettable switch 43. A resettable type switch 43 may employ any suitable means used in the art to indicate it has actuated, such as devices of the type employed in electrical circuit breakers.

While present exemplary embodiments of this invention, and methods of practicing the same, have been illustrated and described, it will be recognized that this invention may be otherwise variously embodied and practiced within the scope of the following claims.

What is claimed is:

1. In a canister type vacuum cleaner comprising, a vacuum tank having an electric powered vacuum unit, an electrical cord assembly connected to said tank and unit for supplying electrical power thereto from a power source, a cleaning instrument for operation remotely from said vacuum tank, an electric motor for driving said cleaning instrument, a vacuum hose assembly operatively connecting said cleaning instrument to said vacuum tank, an electrical system for supplying electrical power from said tank to said cleaning instrument, said electrical system having cooperating electrical leads comprising a pair of wires extending along said hose assembly and serving the dual purpose of electrical conductors and hose reinforcing wires, said dual-purpose wires due to their reinforcing character having a comparatively high electrical resistance which under abnormal electrical operating conditions tends to cause substantial heating thereof and electrical leads of said electrical system operatively associated therewith, the improvement comprising a thermally actuated switch which breaks the electrical circuit through said cooperating electrical leads once a predetermined temperature level is reached by said switch.

2. In a vacuum cleaner as set forth in claim 1 the further improvement in which said thermally actuated switch is actuated once the temperature thereof reaches a predetermined temperature within a tolerance range of plus 0° Centigrade and minus 4° Centigrade.

3. In a vacuum cleaner as set forth in claim 1 wherein said cooperating electrical leads are also comprised of an electrical electical cable assembly electrically connected to said pair of wires the further improvement wherein said switch is connected in series with an electrical lead of said cable assembly.

4. In a vacuum cleaner as set forth in claim 3 in which each of said electrical connectors has a pair of electrical elements with each element connected to an associated lead, the further improvement in which said switch is connected between an element and its associated lead.

5. In a vacuum cleaner as set forth in claim 4 in which each of said electrical connectors has an electrical insulating material serving as a matrix for and surrounding an embedded portion of each of said electrical elements the further improvement comprising means for connecting and removing said switch between an element and its associated lead while keeping the embedded portion of said element in a protected position.

6. In a vacuum cleaner as set forth in claim 1 wherein said cooperating electrical leads are also comprised of an electrical cable assembly having electrical connectors at opposite ends thereof one of said electrical connectors being electrically connected to a cooperating connector of said tank and the other of said electrical connectors being electrically connected to said pair of wires of said hose assembly, the further improvement wherein said switch is connected in series with an electrical lead of said cable assembly.

7. In a vacuum cleaner as set forth in claim 1 the further improvement in which said switch is connected in series with a wire of said hose assembly.

8. In a vacuum hose assembly for a canister type vacuum cleaner comprising, a vacuum hose, a pair of hose connectors provided at opposite end positions of said hose, a pair of wires extending along said hose and serving the dual purpose of electrical conductors and hose reinforcing wires, an electrical connector associated with each hose connector and having said dual-purpose wires connected thereto, said dual-purpose wires due to their reinforcing character having a comparatively high electrical resistance which under abnormal electrical operating conditions tends to cause substantial heating thereof, the improvement comprising, a thermally actuated switch connected in series with at least one of said wires which breaks an electrical circuit through said wires with said hose assembly operatively connected on said vacuum cleaner and once a predetermined temperature level is reached by said switch.

9. In a vacuum hose assembly as set forth in claim 8 in which each of said hose connectors is molded against an associated end of said hose and each hose connector has associated end portions of said wires embedded therein, the further improvement in which said switch is connected in series in an associated end portion of a wire.

10. In a vacuum hose assembly as set forth in claim 9 the further improvement comprising means for connecting and removing said switch in said associated end portion of said wire.

11. In a vacuum hose assembly as set forth in claim 9 the further improvement in which said associated end portion of said wire has a cutout defining a pair of spaced ends, a pair of tubular members fixed to said spaced ends which cooperate to define a female electrical connector embedded in its hose connector, said switch has a plug adapted to be connected with said female electrical connector.

12. In a vacuum hose assembly as set forth in claim 11 the further improvement in which said switch has a main body portion with said plug extending outwardly therefrom and said plug is a quick connect-disconnect type plug.

13. In a vacuum hose assembly as set forth in claim 12 the further improvement wherein said wires are copper clad carbon steel wires whereby said hose assembly is of optimum economy.

14. In a vacuum hose assembly as set forth in claim 12 the further improvement wherein said switch is of a nonresettable type and must be replaced once it has actuated by reaching said predetermined temperature level.

15. In a vacuum hose assembly as set forth in claim 14 the further improvement comprising means on said switch indicating it has actuated.

16. In a vacuum hose assembly as set forth in claim 8 wherein said vacuum cleaner has a high electrical current actuated fuse installed in an electrical circuit with said wires the further improvement wherein said switch is installed against a part of said hose assembly in said circuit with said fuse and breaks said electrical circuit once said switch reaches said predetermined temperature.

17. In a method of making a vacuum hose assembly for a canister type vacuum cleaner comprising the steps of, providing a vacuum hose, forming a pair of hose connectors at opposite ends of said hose, extending a pair of wires along said hose, said wires serving the dual purpose of electrical conductors and hose reinforcing wires, said dual-purpose wires due to their reinforcing character having a comparatively high electrical resistance which under abnormal electrical operating conditions tends to cause substantial heating thereof, and installing an electrical connector at each end of said wires adjacent an associated hose connector, the improvement comprising the steps of, connecting a temperature responsive electrical device on said assembly to detect temperatures of said hose assembly above a predetermined temperature.

18. In a method of set forth in claim 17 the further improvement in which said connecting set comprises connecting said device in the form of a thermally actuated switch in series with at least one of said wires to break the electrical circuit through said wires once said predetermined temperature is reached.

19. In a method as set forth in claim 18 the further improvement comprising providing quick connect-disconnect means on said switch and said one wire to enable easy connection of said switch during said connecting step and similar easy removal of said switch from its connected position.

20. In a method as set forth in claim 18 the further improvement in which said connecting step comprises connecting said switch in series with an end portion of said one wire which is disposed in an associated hose connector.

* * * * *